United States Patent [19]

Bochan

[11] 3,952,557

[45] Apr. 27, 1976

[54] WOBBLE WASHING MACHINE

[75] Inventor: John Bochan, Louisville, Ky.

[73] Assignee: General Electric Company, Louisville, Ky.

[22] Filed: June 20, 1974

[21] Appl. No.: 481,201

[52] U.S. Cl. ..... 68/23.3; 68/171; 68/23.1; 210/144

[51] Int. Cl.[2] ..... D06F 23/02

[58] Field of Search ..... 68/23.1, 23.2, 23.3, 68/23.6, 19, 133, 148, 152–154, 171, 172, 174, 181 R, 208; 210/144; 233/1 D, 1 R, 23 A

[56] References Cited

UNITED STATES PATENTS

| | | | |
|---|---|---|---|
| 2,578,278 | 12/1951 | Archbold | 68/171 |
| 3,135,689 | 6/1964 | Antinori | 68/23.3 X |
| 3,285,419 | 11/1966 | Smith | 68/23.1 X |

FOREIGN PATENTS OR APPLICATIONS

| | | | |
|---|---|---|---|
| 51,902 | 7/1889 | Germany | 210/144 |

*Primary Examiner*—Richard E. Aegerter
*Assistant Examiner*—Larry Jones
*Attorney, Agent, or Firm*—Frederick P. Weidner; Francis H. Boos

[57] ABSTRACT

An automatic washing machine of the fresh water flow through, vertical axis, wobble type has a dynamic system which includes a single imperforate wash basket arranged for rotation and oscillation about its vertical axis and a diametrically opposed set of masses arranged for rotation about the same vertical axis. A hollow vertical shaft couples the rotatable wash basket and the rotatable mass system to a shifting nodal point, damped gyratory suspension system mounted upon the cabinet base. During the washing operation, the basket is prevented from rotation and oscillatory motion is transferred thereto as a result of the rotation of the system of masses. The system of masses is only slightly statically unbalanced but the members are vertically offset with respect to each other such that they form a dynamically unbalanced couple, the effect of vibration of which is to cause turnover and simultaneous circumverential tumbling of clothes placed within the wash basket. During the centrifugal water extraction process, the mass system is prevented from rotation and the wash basket is rotated at high speed. Water removed from the clothing travels to an annular chamber formed along the bottom portion of the wash basket so as to counter any unbalance formed as a result of the clothing being off-center. The system of masses during this process serves to further counter any unbalance resulting from the rotation of the basket. A reversible electric motor is vibrationally isolated from the dynamic system and is coupled through a centrifugal clutch such that rotational motion is transferred to the basket and the mass system respectively through a flexible coupling and a spring clutch system.

8 Claims, 2 Drawing Figures

WOBBLE WASHING MACHINE

BACKGROUND OF THE INVENTION

1. Field of the Invention

The present invention relates to a washing machine for the washing of fabrics and items of clothing and more particularly, to a washing machine of the vertical axis, wobble type wherein a single basket retains both the items being washed and the washing medium.

2. Description of the Prior Art

Conventional clothes washing machines are generally of the vertical axis agitator type and are traditionally rather large and complex. In such machines, generally there is provided a cabinet enclosing an outer water-retaining tub within which is situated a clothes retaining basket. An agitator is mounted within this inner basket and along with the basket, the assembly is coupled through a suitable power transmission with an electric motor. The transmission is a necessity to convert from the high RPM motor to the speeds necessary for centrifugal extraction of water and for the oscillatory motion of the agitator during the wash cycle. Such machines generally include a water pump for recirculating water within the machine and a filter for separating out lint and other particles from this recirculation flow. Included with the pump and filter mechanism is a plethora of plumbing and hoses as well as a water level switch. Inherently then, such machines use large amounts of water and there results a high energy interface between the clothes being washed and the oscillating agitator. Many machines also suffer from vibration and traveling problems resulting from unbalances in the machines during the centrifugal water extraction spinning operation while other machines use complex suspension systems including counterweights, and many times the clothes basket is also provided with an annular balance ring disposed somewhere around the circumference thereof to alleviate this problem.

Attempts have been made to simplify these washing machines, and especially the drive mechanisms thereof and the wobble type of machine appears to have been one of the results. U.S. Pat. No. 2,580,435-Kirby discloses a wobble type of washing machine wherein, although the drive mechanism is simplified, there is still the need for an outer, imperforate water retaining tub. Additionally, the machine would probably suffer from bearing failure problems due to features inherent in the design such as the large rotating mass of the clothes retaining basket. U.S. Pat. No. 2,645,111-Fields discloses a wobble type of washing machine wherein the agitator is placed upon a bent shaft, the agitator being fixed with respect to the clothes retaining basket and thereby not capable of being rotated, however, as the vertical shaft turns, the agitator experiences a gyratory excursion. With this machine also, the bearings would probably be subjected to severe stresses since a rather heavy clothes retaining basket and the agitator are subject to high speed rotation during the centrifugal water extraction process. Such a machine also requires an outer, imperforate water retaining tub.

One fairly simple solution to the simplification problem would seem to be to adopt a combination tub-basket, a single imperforate container which holds both the clothes being washed and the washing medium. With such an arrangement however, during the high speed spin, water extraction process, that imperforate basket, the wet items being washed and the washing medium constitute a rather large mass and the diametral moment of the dynamic system approaches the value of the polar moment thereof. The result is instability much like a spinning ball with the concomitant traveling or walking of the machine. Rather sophisticated suspension systems are required as are heavy weights to hold the machine down and to dampen vibrations resulting from unbalance in such an arrangement.

It is desirable then to provide a washing machine of the vertical axis, wobble type wherein the outer water-retaining tub is eliminated thereby resulting in a single, imperforate basket for receiving both the items to be washed and the washing medium. It is also desirable to provide such a wobble washing machine that has centrifugal water extraction capabilities but which has a simplified drive mechanism. It is also desirable to provide such a wobble washing machine which is stable and not susceptible to walking or traveling during the high speed spin process and which has a fairly simple suspension system without need for a plurality of counterbalances. It is also desirable to provide such a wobble washing machine wherein there is no need for a water recirculation system whereby plumbing, such as hoses and the like, is kept to a minimum. It is also desirable to provide such a washing machine wherein a small amount of water is used to effect washing and rinsing of clothes therein. By the present invention, there is provided such a washing machine of the vertical axis, wobble type which is rather simple of construction, highly reliable and of fairly low cost and which meets the requirements hereinbefore described.

SUMMARY OF THE INVENTION

In accordance with the present invention, there is provided a washing machine including a cabinet and arranged therein an imperforate wash basket for receiving items to be washed, the basket being statically and dynamically balanced and arranged for rotation about a concentric vertical axis thereof for effecting centrifugal water extraction from the items being washed. Inertia means are provided arranged in the cabinet below the wash basket for rotation about a vertical axis coaxial with that of the wash basket, the inertia means being balanced statically and forming a dynamically unbalanced couple, such that when rotated, the basket is caused to oscillate for effecting turnover of items placed therein to be washed, and when the basket is rotated, the inertia means acts to stabilize the mass by counteracting unbalance resulting therefrom. Also included are means, arranged in the cabinet, for rotating the inertia means while preventing the basket from simultaneously rotating and for rotating the basket while preventing the inertia means from simultaneously rotating. A damped, gyratory suspension system is arranged in the cabinet for isolating the cabinet from forces induced by oscillating and rotational motions therein.

In the preferred embodiment, the gyratory suspension system is of the shifting nodal type, and the inertia means is slightly statically unbalanced and when rotated causes the wash basket to experience an oscillatory excursion such that items placed in the basket to be washed will also travel a circumferential path therewithin.

BRIEF DESCRIPTION OF THE DRAWINGS

In the accompanying drawings

DESCRIPTION OF THE PREFERRED EMBODIMENT

Figure 1:
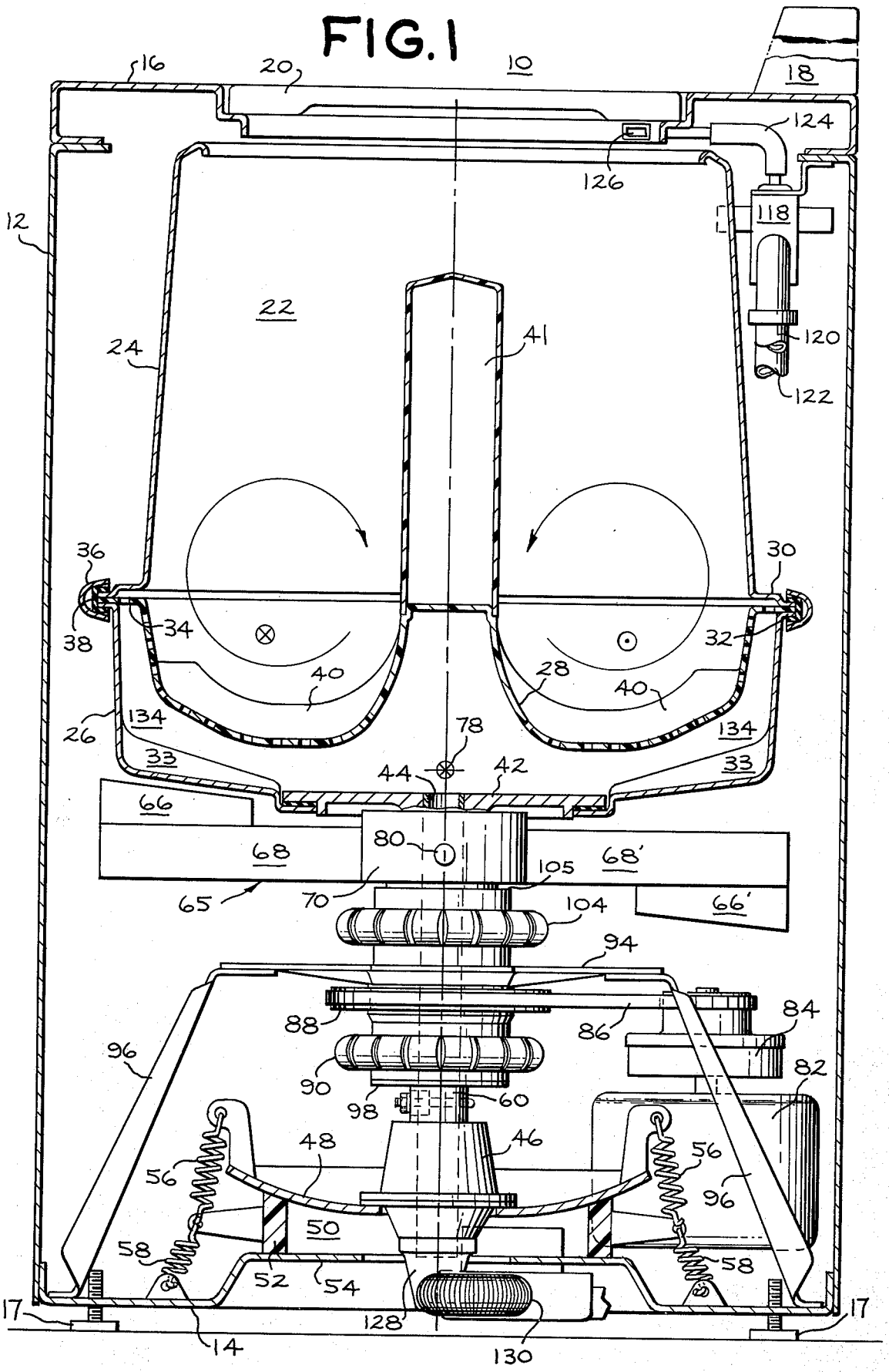
FIG. 1 is a side elevational view of a preferred embodiment of the washing machine of the present invention, the washing machine of the present invention, the view being partly in section.

In accordance with the present invention and referring now to FIG. 1, there is shown a washing machine 10 of the vertical axis, wobble type which includes a cabinet 12 having a base portion 14 and a top 16. Such a machine is normally supplied with four screw thread type leveling legs 17 (only two of which are shown) for adjusting and leveling the machine to various floor surfaces. Cabinet top 16 includes a control panel 18 normally provided with a plurality of switches and controls necessary for the operation of the machine and which are normally coupled into the electric circuitry including a motor. Cabinet top 16 also is provided with an access lid 20 normally hinged (not shown) for movement between a closed position as shown and an open position for gaining access into the interior of the washing machine.

A single imperforate wash basket 22 is provided for receiving items such as clothing to be washed as well as the washing medium, usually water. It is intended that wash basket 22 be of rather light weight and may for example be molded from a plastic material such as polypropylene. The basket 22 is formed of three major parts, namely: A top 24, a bottom 26 and a perforate false bottom 28. Top 24 is in the general shape of a frustum of a cone and is provided with an annular flange 30 for mating with an annular flange 32 formed on bottom 26 for assembly purposes. Bottom 26 is provided with a plurality of radial fins 33 secured thereto to prevent surging of water in the base, especially as the basket is rotated. Perforate false bottom 28 is formed to provide an annularly shaped depression or concave surface wherein items to be washed will generally lie. False bottom 28 is also provided with an annular flange 34 such that upon assembly, an annular clamp 36 will be placed over an annular seal gasket 38 to form the wash basket. False bottom 28 in addition to being provided with a plurality of drain holes is also provided with a series of six helical ribs 40 along its bottom and side, the purpose of which is to aid in the turnover of clothes placed therein. A vertical shaft-like projection 41 is secured to the center of false bottom 28 and serves to prevent large items such as sheets from lying across the basket so as to hinder turnover and washing action. The assembled wash basket 22 is then secured in water-tight fashion to a mounting plate 42 which is then in turn rigidly secured to the upper end of a vertical shaft 44. By this arrangement, wash basket 22 is arranged for rotation about the vertical axis which coincides with the center line as shown in the drawing. In the rest position, when the basket is empty, the center of gravity thereof rests on this center line.

Figure 2:
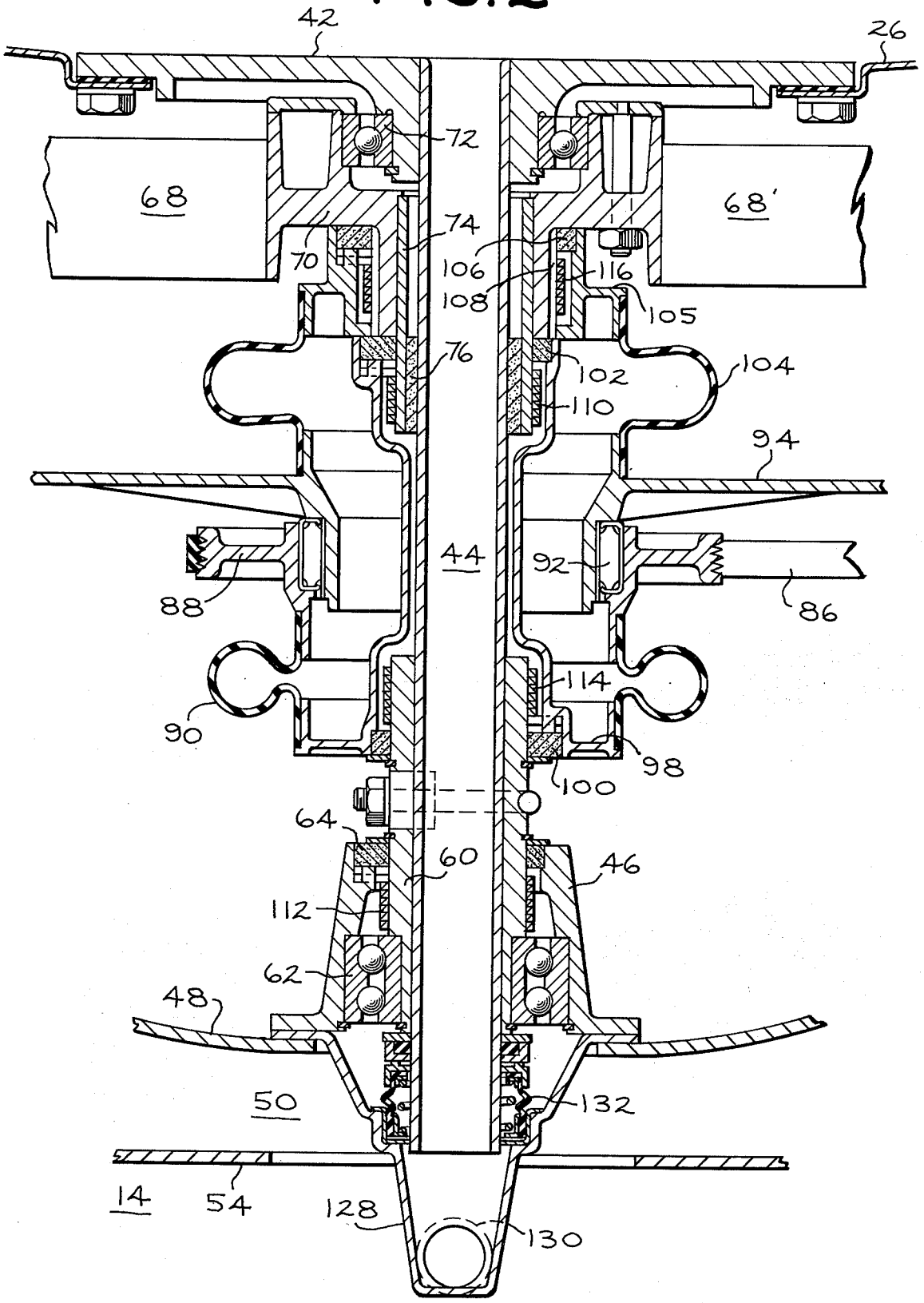
FIG. 2 is a cross-sectional view of the drive train and working mechanism of the preferred embodiment of the present invention, the view being enlarged for clarity.

Referring also now to FIG. 2, it can be seen that vertical shaft 44 is a hollow elongated shaft which serves as the mounting structure for the various components of the drive mechanism of the washing machine as well as for the wash basket 22. It can also be seen that vertical shaft 44 is rotatably secured and to this end has its lower end journaled through a bearing system to a support member 46 which is in turn rigidly secured to a spherically shaped sheet metal dish 48 forming one portion of a damped, gyratory suspension system 50. This suspension system 50 also includes a ring 52 which serves as a frictional, bearing surface between spherical dish 48 and a metal, flat plate surface 54, a raised portion of the base 14. Ring 52 is preferably formed of material having lubricity, such as, for example, polytetrafluoroethylene. Also provided as a part of the suspension system 50 are a plurality of sets of combination centering and damping force varying springs 56 and 58 coupled between the spherical dish 48 and the ring 52 and between ring 52 and the machine base 14 respectively. It is expected that there would be normally supplied three sets of such springs equally spaced around the periphery of spherical dish 48. However this is not absolute and more sets may be provided should the need arise.

The suspension system just described is a damped, gyratory system of the shifting nodal type and when excited, the vertical shaft 44 may move in addition to rotationally, in either of two modes or in a combination of both modes. In the first mode, the vertical shaft can translate so that the vertical axis always remains vertical and in such a case there will be slippage between the lower surface of the ring 52 and the flat plate surface 54. In the second mode, the vertical shaft can translate using the center of the spherical dish 48 as a node and in such a case slippage will occur between the upper surface of the ring 52 and the spherical dish 48. Normally the motion of this vertical shaft 44 is a combination of both modes and the ring 52 will see slippage at both top and bottom faces. Since the critical or resonant frequency of the two modes of motion may be different, they may require differing damping forces and for this reason suspension system 50 is provided with springs 56 and 58 of differing values, thereby serving to create a different damping force for each mode for optimum operation. It will be noted that the springs also serve as a centering means for the dynamic system of the washing machine which of course includes wash basket 22 and the vertical shaft 44.

Referring again more specifically to FIG. 2, a description of the rotational support of vertical shaft 44 with respect to the gyratory suspension system and particularly to the spherical dish 48 thereof will follow. Vertical shaft 44 has been provided with a coaxial, hardened metal, outer surface in the form of a tight fitting, hardened-steel sleeve 60 which serves as the bearing surface for the drive means to be described hereinafter. A double ball bearing 62 serves as a vertical load carrying bearing and provides the rotational bearing surface between sleeve 60 and thereby vertical shaft 44 and support member 46 which is securely attached to spherical dish 48. A permanently lubricated bearing 64 provides an additional bearing surface between sleeve 60 and support member 46.

Referring generally now to FIGS. 1 and 2, to provide the needed oscillatory motion to wash basket 22 for effecting movement of items placed therein to be washed thereby to yield a washing action, there is provided inertia means generally referred to as 65, including a pair of masses 66 and 66′ mounted in diametrically opposed fashion for rotation about the vertical shaft 44. Masses 66 and 66′ are secured respectively to a pair of elongated rod-like members 68 and 68′ which are in turn secured by appropriate means to a generally annular support member 70. A ball bearing assembly 72 provides the bearing surface between support member 70 and thereby the inertia means 65 and vertical shaft 44 through mounting plate 42 of the wash basket 22. A bearing surface is provided for support member 70 in the form of a hardened steel insert 74 which is press fitted into mating engagement with support member 70. A second bearing is then provided between the inertia means 65 and vertical shaft 44 in the form of a permanently lubricated bearing 76. With such an arrangement, since masses 66 and 66′ are equal and since their moment arms 68 and 68′ are equal, inertia means 65 is in essence statically balanced. However, since the centers of gravity of the masses 66 and 66′ are dislocated vertically with respect to each other, the effect is to produce a dynamically unbalanced couple which, when rotated, seeks to belance itself out by moving from the offset to a neutral position, the net effect of which is to transmit vibration to the dynamic system including wash basket 22. Any given point on the wash basket 22 outer wall moves in an orbit of small circumference which in the present embodiment effects turnover of items placed in the basket to be washed in the directions shown by the arrows in FIG. 1.

As has been described, when the inertia means 65 which is in a statically balanced condition is rotated, wash basket 22, prevented from rotation, will experience an oscillatory excursion as will the rest of the dynamic system about a nodal point 78 designated by an encircled X in the FIG. 1. This is an approximate location of this nodal point when the washing machine is loaded with a given 8 lb. load of clothes to be washed. It is however desirable that, in addition to experiencing turnover as just described, that the clothes also experience traveling within the basket 22 in a circumferential path for improved washability. To this end, a mass of approximately 680 grams is placed on support member 70 at location 80 approximately 90° displaced from masses 66 and 66′ so as not to change the dynamic couple such that when the inertia means 65 including masses 66 and 66′ and the support member 70 are rotated about the vertical shaft 44, the net effect will be to produce a pseudo node, a shifting nodal point. That is, nodal point 78 will now experience a gyratory excursion essentially about the center line axis. The results then are, when the inertia means 65 is rotated clockwise as viewed from the top, the nodal point 78 will also experience a clockwise gyratory excursion resulting in a pseudo-node and clothes in basket 22 will also simultaneously travel around the bottom of the basket in a clockwise direction as indicated in the drawing by an encircled X and an encircled dot.

During the centrifugal water extraction process, a high speed spinning operation, inertia means 65 and thereby masses 66 and 66′ are prevented from rotation while basket 22 is rotated in a counter-clockwise direction, viewed from the top, at a high velocity. During this basket spinning process, the inertia means 65 including the masses 66 and 66′ as well as the elongated rods 68 and 68′ and support member 70 act to stabilize the mass of the dynamic system by counteracting unbalance resulting during the high speed rotation of the wash basket 22.

Means are provided for rotating inertia means 65 while preventing wash basket 22 from rotating, and during the centrifugal water extraction process, for rotating the basket 22 while preventing inertia means 65 from simultaneously rotating. To this end, there is provided a reversible electric motor 82 rigidly secured to the base 14 of the cabinet 12 so as to be isolated from the dynamic system of the washing machine. Motor 82 is coupled by a centrifugal clutch 84 to a drive belt 86 and thence to a pulley 88 arranged for rotation essentially about the vertical axis of the dynamic system. With such an arrangement, the motor starting torque can be very low as compared with that used in an agitator type machine. Pulley 88 is however vibrationally isolated from the rotational elements of the dynamic system by a flexible coupling 90. Pulley 88 is rotationally secured through a needle bearing assembly 92 to a ground plate 94, an annularly shaped member which is secured to the base 14 by a plurality of support struts 96. The net effect then is to isolate the dynamic system from any vibration resulting from operation of the motor 82, the belt 86 and pulley 88.

Rotational motion from the motor 82 is then transferred to a pulley-like member 98 journalled coaxially about vertical shaft 44 through a pair of permanently lubricated bearings 100 and 102.

A second flexible coupling 104 is secured on one side to ground plate 94 and on the other side to a generally annular retaining device 105 mounted axially with support member 70 and thereby vertical shaft 44 but journalled about support member 70 through a permanently lubricated bearing 106 and a hardened steel sleeve 108 tightly fitted over support member 70.

For transmitting rotation from the motor 82 through pulley 88 and pulley-like member 98, in the washing operation, a pair of spring clutches 110 and 112 are provided, such that when the motor turns in a clockwise direction as viewed from the top, spring clutch 110 will become engaged to transfer rotation from pulley-like member 98 to inertia means 65 through hardened metal insert 74 and thereby support member 70. At the same time, spring clutch 112 becomes engaged to secure sleeve 60 and thereby vertical shaft 44 and the wash basket 22 to support member 46 thereby to prevent the rotation of the wash basket.

For transmitting rotation from motor 82 during the high speed centrifugal extraction process, the motor 82 is reversed to rotate in a counter-clockwise direction as viewed from the top and a spring clutch 114 is provided for coupling the pulley-like member 98 to the vertical shaft 44 and thereby wash basket 22 through sleeve 60. To prevent the rotation of inertia means 65 during the basket spin process, a spring clutch 116 is provided for coupling support member 70 to retainer 105 and thence to ground plate 94 through flexible coupling 104.

Washing machine 10 has been designed to be of the fresh water, flow-through type with the result that there is no need for a water recirculating pump or water filtering system. The machine may however be provided with means in the form of solenoid operated, mixer valves 118 suitably coupled to a source of hot and cold water, such as household faucets, through hoses 120 and 122 respectively. The output of mixer valves 118 then is fed through a conduit 124 and thence to a nozzle 126 whereupon the water is free to flow into wash basket 22. After passing through the items being washed and thence through the perforations of false bottom 28, the water and any sand is free to flow into the bottom 26 of the basket and thence to the hollow vertical shaft 44. Water is then drained down the vertical shaft into a housing 128 suitably secured to support member 46, and thence through a hose 130 to a suitable disposal system. A pump may be provided associated with the washing machine for aiding in the removal of the drain water from the housing 128. A rotary water seal 132 is provided to prevent water draining from vertical shaft 44 from flowing back into support member 46 thereby to cause damage to the ball bearing assembly 62 and other components of the drive system.

It should be mentioned at this point that during the centrifugal water extraction process, the high-speed basket spin operation, water removed from the clothes is not free to travel immediately to the vertical shaft 44 to be drained but instead proceeds to an annulus chamber 134 formed of basket 22 where it stays for the remainder of the basket spin operation. By this function, automatic balancing is provided in the wobble washing machine and is accomplished by making the first resonant frequency of the rotating system low enough so that little water is initially extracted from the clothes, and upon exceeding this frequency, the water which is then removed tends to move to a position in this annulus chamber opposite the unbalance formed by the clothes as the machine tries to rotate about a new center of gravity caused by the unbalance: in other words, the water creates a balancing force which tends to make the basket run more smoothly.

A typical clothes washing operation might proceed as follows: The clothes to be washed along with necessary detergent is placed within the basket and upon choosing the appropriate times and water temperatures provided, the machine is turned on at which time water starts to flow and at the same time the inertia means 65 including masses 66 and 66' rotate clockwise at approximately 730 RPM. The wash basket makes a gyratory excursion but does not rotate and spent water and any sand which drains from those items being washed passes through the false bottom of the basket into the bottom thereof and thence through the vertical shaft 44 to be drained from the machine. Since this is a flow through type of machine, this draining process is a continual one. The rinse process is a continuation of the wash process but there would normally be a water temperature selection required with water continually flowing through and being drained from the machine for the duration of the rinse process. Upon the conclusion of the wash and rinse portions of the cycle, the water flow stops and the machine is ready to enter into the centrifugal water extraction basket spin process. The wash basket 22 begins to rotate and does so at the rate of approximately 730 RPM while the inertia means 65 including the masses 66 and 66' are secured from rotating thereby to act as balancing means. Water being extracted from the clothes is not free to drain from the wash basket but instead is stored in the annulus chamber in the lower portion of the wash basket thereby serving as an additional balancing means for the rotating system. In practice it has been found that the annulus chamber 134 is at times not large enough to contain all the water removed from items being washed. The spin operation has been therefore divided into three portions, with a slight pause after each of the first two portions to allow water to drain out of the machine. The third portion is a long one and in fact, the only portion wherein the basket gets up to full spin. It is during this portion that the balancing effect heretofore described is effected and is indeed necessary, At the end of the time allotted for the spin cycle, the motor is turned off and the water drains from the annulus chamber 134 of the basket down through the vertical shaft 44 and out of the machine.

It has been found that for an acceptable wash cycle, approximately six gallons of water are necessary for an 8 lb. load and perhaps another six gallons are necessary, usually cold water, for the rinse portion of the wash cycle. These values compare with the approximately 16 gallons normally needed in a conventional washer for washing an 8 lb. load. A machine capable of the above performance would normally be 21 inches by 21 inches by 30 inches high and each of the masses 66 and 66' perform satisfactorily with 3.2 kilograms each. It can be readily seen that there is no need for a balance ring on the wash basket since this function is served by the inertia means 65 and likewise a water level switch is not needed, the water being provided through a timed flow arrangement. It can also be seen that there is no high energy interface between the clothes and the washing means as in the case of an oscillatory agitator, and the net effect is less wear and no tearing in clothing being washed. The electric motor may be of the type having a low starting torque since a centrifugal clutch is used, but is preferably of the direction reversible type. It can also be readily seen that there is no transmission, that the drive mechanism includes no oil or gears and essentially runs at the spin speed which is determined by motor speed, the diameter of the pulley associated with centrifugal clutch 84 and the diameter of pulley 88. Furthermore it can be seen that there is provided a symmetrical type of suspension system which does not require damping counterweights, the damping being incorporated in the suspension system itself.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A washing machine comprising:

a cabinet;

an imperforate wash basket arranged in the cabinet for receiving items to be washed, the basket being statically and dynamically balanced and arranged for concentric rotation about a vertical axis thereof for effecting centrifugal water extraction from items being washed;

inertia means including a pair of masses diametrically opposed and dislocated vertically with respect to each other secured to a connecting member and arranged in the cabinet below the wash basket for rotation about a vertical axis coaxial with that of the wash basket, the inertia means being balanced statically and forming a dynamically unbalanced couple, and when rotated the basket is caused to oscillate relative to its vertical axis for effecting turnover of items placed therein to be washed, and when the basket is rotated, the inertia means acts to stabilize the mass by counteracting unbalance resulting therefrom;

means arranged in the cabinet for rotating the inertia means while preventing the basket from simultaneously rotating and alternatively for rotating the basket while preventing the inertia means from simultaneously rotating; and a damped, gyratory suspension system arranged in the cabinet for isolating the cabinet from forces induced by oscillating and rotational motions.

2. The washing machine of claim 1 further comprising:

a substantially vertical shaft rotatably secured near the lower end thereof to the gyratory suspension system, the wash basket being rigidly coaxially secured to the shaft at the uppermost end thereof, and the inertia means being rotatably secured to the shaft at a point below the wash basket.

3. The washing machine of claim 2 further being of the fresh water flow-through type and wherein the vertical shaft is hollow to serve as a draining means and the basket has a perforate, false bottom and an outer, imperforate bottom communicating with the hollow vertical shaft such that water entering the basket passes through the perforate bottom to flow into the hollow vertical shaft and thence from the washing machine.

4. The washing machine of claim 1 wherein the means for rotating includes a motor rigidly secured to the cabinet coupled with a pulley by a drive belt, the pulley being vebrationally isolated from and arranged for coupling to the basket and the inertia means, respectively, through a flexible coupling and a series of spring clutches.

5. A washing machine comprising:

a cabinet;

an imperforate wash basket arranged in the cabinet for receiving items to be washed, the basket being statically and dynamically balanced and arranged for concentric rotation about a vertical axis thereof for effecting centrifugal water extraction from items being washed;

inertia means including a pair of masses diametrically opposed and dislocated vertically with respect to each other secured to a connecting member and arranged in the cabinet below the wash basket for rotation about a vertical axis coaxial with that of the wash basket, the inertia means being slightly, statically unbalanced and forming a dynamically unbalanced couple, and when rotated the basket is caused to oscillate relative to its vertical axis for effecting turnover of items placed therein to be washed and causes the wash basket to experience an oscillatory excursion such that said items will also travel a circumferential path around the periphery therewithin, and when the basket is rotated the inertia means acts to stabilize the mass by counteracting unbalance resulting therefrom;

means arranged in the cabinet for rotating the inertia means while preventing the basket from simultaneously rotating and alternatively for rotating the basket while preventing the inertia means from simultaneously rotating; and a damped, gyratory suspension system of the shifting nodal type arranged in the cabinet for isolating the cabinet from forces induced by oscillating and rotational motions.

6. The washing machine of claim 5 further comprising:

a substantially vertical shaft rotatably secured near the lower end thereof to the gyratory suspension system, the wash basket being rigidly coaxially secured to the shaft at the uppermost end thereof, and the inertia means being rotatably secured to the shaft at a point below the wash basket.

7. The washing machine of claim 6 further being of the fresh water flow-through type and wherein the vertical shaft is hollow to serve as a draining means and the basket has a perforate, false bottom and an outer, imperforate bottom communicating with the hollow vertical shaft such that water entering the basket passes through the pperforate bottom to flow into the hollow vertical shaft and thence from the washing machine.

8. The washing machine of claim 5 wherein the means for rotating includes a motor rigidly secured to the cabinet coupled with a pulley by a drive belt, the pulley being vibrationally isolated from and arranged for coupling to the basket and the inertia means, respectively, through a flexible coupling and a series of spring clutches.

* * * * *